United States Patent [19]

Bresson et al.

[11] 4,372,844

[45] Feb. 8, 1983

[54] AROMATIC AND BENZOTHIOPHENE EXTENDER OIL COMPOSITION FOR ORE FLOATATION

[75] Inventors: Clarence R. Bresson; Robert M. Parlman, both of Bartlesville, Okla.

[73] Assignee: Phillips Petroleum Company, Bartlesville, Okla.

[21] Appl. No.: 278,126

[22] Filed: Jun. 29, 1981

[51] Int. Cl.[3] ..... B03D 1/14

[52] U.S. Cl. ..... 209/166; 252/61; 210/703; 210/705; 210/728

[58] Field of Search ..... 209/166, 167; 252/45, 252/48.2, 61; 210/728, 727, 725, 724, 705–707

[56] References Cited

U.S. PATENT DOCUMENTS

| | | | |
|---|---|---|---|
| 1,833,464 | 11/1931 | Keller | 209/166 |
| 2,014,717 | 9/1935 | Burdick | 209/166 |
| 2,049,470 | 8/1936 | Perkins | 209/166 |
| 2,147,518 | 2/1939 | Herdrey | 252/45 |
| 2,165,268 | 7/1939 | Vogel-Jorgensen | 209/166 |
| 2,169,313 | 8/1939 | Williams | 209/166 |
| 2,479,513 | 8/1949 | Richter | 252/48.2 |
| 2,480,660 | 8/1949 | Lukasiewicz | 252/45 |
| 2,515,927 | 7/1950 | Lukasiewicz | 209/166 X |
| 2,528,782 | 11/1950 | Reiff | 252/45 |
| 3,016,143 | 1/1962 | Trachta | 209/166 |
| 3,095,377 | 6/1963 | Mart | 252/45 |
| 3,149,788 | 9/1964 | Wilson | 209/166 X |
| 3,250,711 | 5/1966 | Early | 252/45 X |

OTHER PUBLICATIONS

Org. Chem., Richter, 1938, Thiophene Derius, 649, 650.

Koks. Khimiya, 1974, No. 3, 10–12, 12–14, Prod'n. & Use of Some Alkyl Arom. Comps. as Flot. Reagt's.

*Primary Examiner*—Norman Yudkoff

[57] ABSTRACT

An extender oil characterized as having a viscosity at 100° F. in a range of about 40 to about 250 SUS and an aromatic content in the range of about 60 to about 85 wt % of the total collector composition of which about 10 to about 20 wt % of the total collector composition is chosen from among benzothiophenes and dibenzothiophenes. The above-described extender oil blended with the tall oil in a ratio of tall oil to extender oil in a range of about 75 wt %: to about 25 wt % to about 25 wt %:about 75 wt %. The extender oil described above blended with a fatty amine in a ratio of fatty amine to extender oil in a range of about 50 wt %:50 wt % to about 10 wt %:90 wt %. The flotation process for recovering phosphates and/or potash employing the compositions described above.

9 Claims, No Drawings

AROMATIC AND BENZOTHIOPHENE EXTENDER OIL COMPOSITION FOR ORE FLOATATION

BACKGROUND OF THE INVENTION

This invention relates to the beneficiating or concentrating of ores. In one of its aspects this invention relates to the beneficiating or concentrating of ores containing phosphate or potash. In another of its aspects this invention relates to collectors useful in ore beneficiating. In yet another aspect this invention relates to extender oil used in an ore beneficiation.

Flotation is a process for concentrating minerals from their ores. In a flotation process the ore is crushed or wet ground to obtain a pulp. Additives such as flotation or collecting agents and frothing agents are added to the pulp to assist in subsequent flotation steps in separating valuable minerals from the undesired, or gangue, portion of the ore. The flotation or collecting agents can comprise solid material and/or liquids such as oils, other organic compounds, or aqueous solutions. Flotation is accomplished by aerating the pulp to produce a froth at the surface. Minerals which adhere to the bubbles or froth are skimmed or otherwise removed and the mineral-bearing froth is collected in further process to obtain the desired minerals.

In the present invention it has been discovered that $SO_2$ extract oils blended to produce certain physical characterics are particularly effective as extenders in flotation of phosphate and potash from their ores either with or without combination with a frothing agent. These $SO_2$ extract oils are produced by the method that gives them their name in which a hydrocarbon produce mixture is extracted with $SO_2$ thereby removing aromatic compounds into the $SO_2$. The extract is separated and warmed to drive off the $SO_2$ leaving aromatic compounds having negligible amounts of other unsaturated compounds present. Naturally, $SO_2$ extract oils obtain their physical characteristics from the aromatic content of the product mixtures from which they are extracted. Various $SO_2$ extract oils can be blended to achieve certain desired characteristics.

The purpose of an extender oil in a process for beneficiating ores is to provide along with the collector an increased concentration of the desired mineral from its ores.

It is therefore an object of this invention to provide a blend of $SO_2$ extract oil suitable as an extender oil in the collection of phosphates or potash from ores containing these materials. It is another object of this invention to provide a method of beneficiating ores containing phosphates or potash.

Other aspects, objects and the various advantages of this invention will become apparent upon reading the specification and the appended claims.

STATEMENT OF THE INVENTION

According to this invention there is provided a composition of matter useful as a collector in a flotation process for recovering phosphates and/or potash from ore containing the same in which the composition contains an extender oil having characteristics of viscosity at 100° F. in a range of about 40 to about 250 SUS and an aromatic content in a range of about 60 to about 85 wt % of the total collector composition of which about 10 to about 20 weight percent of the total collector composition is made up of benzothiophenes and dibenzothiophenes.

In an embodiment of this invention a flotation process is provided for recovering phosphates and/or potash from ores containing the same using as a collector the composition as described above.

The invention is applicable for the beneficiation of ores, among others, such as apatite, fluorapatite, and the like having phosphatic constituents and potash containing-ores such as sylvite and the like.

In general, the extender oils useful in this invention can be used along with collectors, which may also act as frothing agents; with frothing agents, if desired; and with pH regulators, if desired. In general, the collector may be any material which is known in the art as useful as a collector for phosphates and/or potash such as tall oil, petroleum sulfonates, naphthenic acids, long-chain fatty acids or the soap derivatives thereof all of which are particularly useful in the concentration of phosphatic ores and fatty amines which are particularly useful in the concentration of potash-containing ores. Among the useful fatty amines are N-laurylamine, N-octadecylamine, N-dodecylamine, N-hexadecylamine, polymethylamine, stearylamine, and tallow amines, all of which may be used in the form of the acetate salts as well as distilled primary amine acetates derived from coconut fatty acids, soya fatty acids, and tallow fatty acids.

Among frothing agents which can be used in the present invention, but which are not generally necessary are those frothing agents typically used such as methylisobutylcarbinol, poly(propyleneglycol) 400, pine oil, cresylic acid, polyether alcohol, and hexyl alcohol.

Typically, pH regulation is accomplished by the use of any inorganic basic compound. Those that are preferred for use are caustic soda, soda ash, potassium hydroxide, ammonium hydroxide, and the like. The pH regulator is added during the beneficiation process in an amount to provide a pH as required in the process and as measured during the process.

The extender oils useful in the present invention have been prepared by blending two available extender oil stocks. The inventive extender oil blend has been characterized for the purpose of disclosure of the invention by the physical characteristics that have been theorized to be important in the functioning of the invention although not wishing to be bound by any theory of the invention, it is believed that the relatively high benzothiophene content of the inventive blend of oil is important in its functioning as a flotation extender oil in that the molecular configuration of the benzothiophene compounds being both flat structurally and planar as an aid in the flotation process and since benzothiophene compounds tend to be more polar than most other aromatic compounds, presumably because of the sulfur group, they tend to attract polar minerals including potash and phosphates.

In Table 1 below are presented the properties of extender oils used in determining the operative compositions of this invention. Also believed to be important is the viscosity of the extender oil. The examples below will show that Oil B which has a high viscosity at 100° F. is not as effective as a blend of Oil B with Extract Oil A which has a much lower viscosity at 100° F. The inventive range for viscosity of the extender oil has been arbitrarily set at about 40 to about 250 SUS at 100° F., the upper limit established for ease of handling the oil extended collector, and with a preferred range set at about 100 to about 120 SUS at 100° F., the usual range for desirable blends of 80 weight percent Extract Oil A and 20 weight percent Oil B. For the wider range of viscosity the weight percents can vary from about 60 weight percent Extract Oil A-40 weight percent Oil B to 100 weight percent Extract Oil A. Other oils or blends having characteristics as called for above are also contemplated as useful in this invention.

TABLE I

| Properties of Extender Oils | No. 4 Fuel Oil | No. 5 Fuel Oil | Extract Oil A(1) | Oil B(2) | Preferred Extender Oil Blend |
|---|---|---|---|---|---|
| Gravity, API at 60 F | — | 17.5 | 6.9–8.9 | 4.6–6.6 | 6–10 |
| ASTM D1160 Vac. Dist., F, 700 mm | | | | | |
| 2% Condensed | — | — | 552 | 620 | 552 |
| 5–80% | — | — | 391–741 | 680–918 | 594–805 |
| 90% | — | — | 780 | 992 | 890 |
| Avg. Boiling Point | — | — | 695 | 826 | 728 |
| Viscosity, SUS at 100° F. | — | 150 | 40–100 | 475–675 | 100–120 |
| Viscosity, SUS at 210° F. | — | — | 34.4 | 51.3 | 25–45 |
| Pour Point, F | — | +12 | 15–45 | 50–80 | 35–60 |
| Flash Point, PM, F | — | 130 | 190–290 | 150–225 | 190–240 |
| Mass Analysis | | | | | |
| Den. g/cc | — | 0.937 | 1.01 | 0.964 | .975–.986 |
| Av. Mol. Wt. | 245 | 299 | 218 | 297 | 226 |
| Saturate, Wt. % | 51.5 | 44.8 | 21.4 | 34.6 | 32.9 |
| Paraffins | 27.5 | 21.2 | 12.7 | 14.6 | 14.2 |
| Noncond. cyclopar | 12.5 | 12.2 | 4.7 | 9.0 | 9.2 |
| Cond. cyclopar | 11.5 | 11.4 | 4.0 | 10.8 | 9.5 |
| Aromatics, Wt. % | 48.5 | 55.2 | 60–85 | 60–85 | 60–85 |
| Mono- | 14.5 | 10.7 | 10.3 | 9.7 | 13.9 |
| Di- | 20.6 | 12.3 | 34.9 | 12.5 | 20.1 |
| Tri- | 4.0 | 8.4 | 16.4 | 14.8 | 13.2 |
| Tetra- | 3.9 | 10.9 | 5.6 | 14.3 | 8.0 |
| Penta- | 1.4 | 3.3 | 0 | 0.9 | 0.3 |
| Benzothiopheno | 3.7 | 6.3 | 8–20 | 8–20 | 10–20 |
| Misc. | 14 | 3.3 | 0.1 | 0.7 | 0 |

(1)An $SO_2$ extract obtained from Philips Petroleum Co.
(2)An oil obtained from Texas Gulf Industries.

The amount of extender oil used varies for the type of minerals separated, particularly since the extender oil is used in combination with a collector compound. The preferred collector compounds for this invention are tall oils for phosphate recovery and fatty amines for potash recovery.

In phosphate recovery, the amount of tall oil-extender oil employed can vary generally from about 0.2 pound of blend/ton of feed to 2 pounds of blend/ton of feed. The ratio of tall oil to extender oil can also vary from about 75 weight percent tall oil—25 weight percent extender oil to 25 weight percent tall oil—75 weight percent extender oil. Based on these ranges, the amount of extender oil used in phosphate recovery can vary from 0.05 lb./ton feed to 1.5 lbs./ton feed while the tall oil correspondingly varies from 1.5 lbs./ton feed to 0.05 lb./ton feed.

In potash recovery, the amount of amine-extender oil blend can vary from about 1 lb. of blend/ton feed to about 3 lbs. of blend/ton feed while the ratio of amine to extender oil can vary from 50:50 weight percent to 10:90 weight percent. Based on these ranges, the amount of extender oil used in potash recovery can vary from 0.5 lbs./ton feed to 2.7 lbs./ton feed while the amine can vary from 0.1 lbs./ton feed to 1.5 lbs./ton feed.

The following examples serve to illustrate the operability of this invention.

EXAMPLE I

This example is a control illustrating the effectiveness of No. 5 Fuel Oil in the recovery of phosphate by an ore flotation process. The example represents a typical procedure for this type separation. About 500 grams of a coarse phosphate-containing ore (14×28 Tyler mesh size from Amax mines) was added to a metal beaker and diluted with water to about 72 wt. percent solids. Enough concentrated ammonium hydroxide was added to adjust the pH to 9–9.5, after which, 0.15 grams (0.6 lbs./ton feed) of a 50:50 wt. percent blend of tall oil and No. 5 fuel oil was added and the mixture was stirred for 2 minutes for conditioning. The contents were emptied into a Denver Flotation Cell, Model D-1, diluted with water to about 25 wt. percent solids and stirred at 1400 rpm. Sufficient air (not measured) was supplied to cause flotation. The total flotation time was 4 minutes. The rougher concentrate (21 wt. percent solids) was washed with 5 wt. percent aqueous $H_2SO_4$ followed by a water wash to remove the tall oil (fatty acid) coating on the phosphate ore. The concentrate was filtered, dried and analyzed to indicate 61.02 wt. percent phosphate (BPL) and 15.57 wt. percent insolubles (mostly sand). The rougher tailing BPL content was 1.59 wt. percent. The wt. percent BPL recovery was calculated to be 91.1 percent. The preceding procedure was repeated but at different levels of tall oil-fuel oil. These results are shown in Table II.

The data show that as the tall oil-fuel oil concentration is increased the percent phosphate (BPL recovery) is also increased with a corresponding increase in the rougher concentrate wt. percent and insolubles. Subsequent phosphate ore upgrading with for example primary amine flotation can be carried out if desired.

TABLE II

| Run | Tall Oil-Fuel Oil lb./ton Feed | Effect of Tall Oil-Fuel Oil Concentration of Phosphate Recovery: Rougher Concentrate Wt. % | BPL, % | Insol, % | Rougher Tailing, % BPL | % BPL[a] Recovery |
|---|---|---|---|---|---|---|
| 1 | 0.6 | 21.0 | 61.02 | 15.57 | 1.59 | 91.1 |
| 3 | 0.7 | 23.6 | 56.26 | 21.56 | 1.52 | 92.0 |
| 5 | 0.8 | 27.4 | 50.06 | 31.01 | 1.00 | 95.0 |

[a]Bone phosphate of lime.

EXAMPLE II

This example is the invention illustrating that when the No. 5 fuel oil of the tall oil-fuel oil blend described in Example I is replaced with a mixture of Extract Oil A and Oil B, the recovery of phosphate is significantly increased. The procedure described in Example I was repeated with the exception that No. 5 fuel oil was replaced with a mixture of 80 wt. percent Extract Oil A and 20 wt. percent Oil B referred to as Preferred Extender Oil Blend. These results shown in Table III indicate a higher wt. percent phosphate (BPL) recovery using the invention extender oil blend compared to No. 5 fuel oil when used at the same concentration.

A comparison of the results below with those in Example I can be best seen in Table IV-Summary which shows the improvement in phosphate recovery using the inventive extender oil blend.

TABLE III

| Run | Tall Oil-Preferred Extender Oil[a] lb./ton, Feed | Effect of Tall Oil-Inventive Extender Oil[a] Concentration on Phosphate Recovery: Rougher Concentrate Wt., % | BPL, % | Insol., % | Rougher Tailing, % BPL | % BPL Recovery |
|---|---|---|---|---|---|---|
| 2 | 0.6 | 20.7 | 62.50 | 13.60 | 1.18 | 93.3 |
| 4 | 0.7 | 23.3 | 56.83 | 20.67 | 0.97 | 94.7 |
| 6 | 0.8 | 25.9 | 51.71 | 27.18 | 0.60 | 96.5 |

[a]80% Extract Oil A - 20% Oil B

TABLE IV

| 50% Tall Oil - 50% Extender Oil | Effect of Extender Oil on Phosphate Recovery: % Phosphate[(a)] Recovery Using Extender Oil: No. 5 Fuel Oil (Control - Example I) | Invention Extender Oil Blend (Invention - Example II) |
|---|---|---|
| 0.6 lb./ton feed | 91.1 | 93.3 |
| 0.7 lb./ton feed | 92.0 | 94.7 |
| 0.8 lb./ton feed | 95.0 | 96.5 |

[(a)]BPL (Bone Phosphate of Lime)

EXAMPLE III

This example is a control illustrating the effectiveness of fuel oils in the recovery of potash by an ore flotation process. The procedure described is a general laboratory method for potash separations. Ore, approximately minus 6 Tyler mesh size or smaller, is diluted to 55 to 60 wt. percent solids and scrubbed 4 to 5 minutes in saturated brine solution. The scrubbed ore is then deslimed by adding clean brine and decanting several times. After desliming, the ore pulp density is adjusted to 55 to 60 wt. percent solids with brine and the mixture added to a Wemco laboratory flotation cell. The mixture is conditioned by agitation in the flotation cell for 1 minute. Clay depressant (e.g. starch) can be added at this point. Three milliliters of the flotation reagent was added and the mixture conditioned at 1075 rpm for about 2 minutes. This flotation reagent, referred to as blend A is comprised of 0.5 lb./ton feed of hydrogenated fatty acid amine plus 1.5 lbs./ton feed of TGI fuel oil made up as 37 milliliters of a 5 wt. percent aqueous fatty acid amine plus 4.5 milliliters oil. Within 10-15 seconds from the end of the conditioning period, 2 drops of methylisobutylcarbinol is added as a frother after which air is turned on to start flotation. Flotation is complete in 1.5 minutes. The rougher concentrate is filtered, wash with methyl alcohol to remove brine, dried and analyzed. Thus, there was obtained a 77.76 weight percent recovery of potassium chloride calculated as potash ($K_2O$). A repeat experiment gave a 78.72% $K_2O$ recovery.

The preceding procedure was repeated with the exception that the TGI oil used was replaced with a blend of No. 5 fuel oil and a No. 4 fuel oil. This new blend is referred to as blend C. When 3 milliliters of this blend was used, the $K_2O$ wt. percent recovery was 86.56. When 4 milliters of blend was used the $K_2O$ wt. percent recovery dropped to 84.99. Even so, blend C appeared to be better than blend A when used to float potash.

EXAMPLE IV

This example is the invention illustrating that when the oil described in Example III (blends A and C) is replaced with a blend of Extract Oil A and Oil B, the recovery of potash is improved. The procedure described in Example III was repeated except the Oil B or the blend of No. 5 and No. 4 fuel oils was replaced with a blend of 80 wt. percent $SO_2$ Extract Oil A and 20 wt. percent Oil B. This latter blend is referred to as blend B. These results indicate a higher $K_2O$ wt. percent recovery using blend B than when blends A or C are used. The data is listed in Table V along with data from Example III for comparison.

TABLE V

| Effect of Extender Oil on Potash Recovery | % $K_2O$[a] Recovery |
|---|---|
| A. Control Runs | |
| 1. 3 mL Blend A[b] | 77.76 |

TABLE V-continued

Effect of Extender Oil on Potash Recovery

| | % $K_2O$[a] Recovery | |
|---|---|---|
| | | 78.24 av. |
| 3 mL Blend A | 78.72 | |
| 2. 3 mL Blend C[c] | 86.56 | |
| | | 85.78 av. |
| 4 mL Blend C | 84.99 | |
| B. Inventive Runs | | |
| 1. 3 mL Blend B[d] | 86.78 | |
| | | 87.60 av. |
| 4 mL Blend B | 88.34 | |

[a]KCl calculated as $K_2O$.
[b]0.5 lbs./ton feed of hydrogenated fatty acid amine plus 1.5 lbs./ton feed Oil B.
[c]0.5 lbs./ton feed of hydrogenated fatty acid amine plus 1.5 lbs./ton feed of mixture of 80 wt. % No. 5 fuel oil plus 20 wt. % No. 4 fuel oil.
[d]0.5 lbs./ton feed of hydrogenated fatty acid amine plus 1.5 lbs./ton feed of preferred extender oil blend.

We claim:

1. A composition of matter useful as an extender oil in a flotation process for recovering phosphates and/or potash from ore containing the same, said composition comprising an extender oil having characteristics of viscosity at 100° F. in a range of about 40 to about 250 SUS and an aromatic content in the range of about 60 to about 85 weight percent of the total oil composition of which about 10 to about 20 weight percent of the total oil composition is chosen from the group consisting of benzothiophenes and dibenzothiophenes.

2. A composition of claim 1 wherein the viscosity at 100° F. is in a range of about 100 to about 120 SUS.

3. A composition of claim 1 or 2 for recovering phosphate also comprising a tall oil in a ratio of tall oil to extender oil in a range of about 75 wt %:25 wt % to about 25wt %:about 75 wt %.

4. In a flotation process for recovering phosphates from ores containing the same the improvement of employing a composition of claim 3 as collector.

5. A composition of claim 1 or 2 for recovering potash also comprising a fatty amine in a ratio of amine to extender oil in a range of about 50 wt %:50 wt % to about 10 wt %:90 wt %.

6. In a flotation process for recovering potash from ores containing the same the improvement of employing a composition of claim 5 as a collector.

7. A composition of claim 5 wherein said fatty amine is chosen from among a group consisting of N-laurylamine, N-octadecylamine, N-dodecylamine, N-hexadecylamine, polymethylamine, stearylamine, and tallow amines, all of which may be used in the form of the acetate salts as well as distilled primary amine acetates derived from coconut fatty acids, soya fatty acids, and tallow fatty acids.

8. In a flotation process for recovering potash from ores containing the same, the improvement of employing a composition of claim 7 as a collector.

9. In a flotation process for recovering phosphates and/or potash from ores containing the same the improvement of employing a composition of claim 1 or 2 as a collector.

* * * * *